United States Patent [19]

Smith

[11] Patent Number: 4,586,354

[45] Date of Patent: May 6, 1986

[54] MOUNTING A DEVICE ON A MEMBER

[75] Inventor: Paul D. Smith, Birmingham, England

[73] Assignee: Lowe & Fletcher Ltd., West Midlands, England

[21] Appl. No.: 574,409

[22] Filed: Jan. 27, 1984

[30] Foreign Application Priority Data

Jun. 24, 1983 [GB] United Kingdom ..... 8317245

[51] Int. Cl.[4] ..... E05B 9/08

[52] U.S. Cl. ..... 70/451; 70/370; 70/381

[58] Field of Search ..... 70/451, 452, 370, 381, 70/448, 449; 292/349; 248/27.3; 411/176, 177, 180, 217, 219, 221, 516, 519, 521

[56] References Cited

U.S. PATENT DOCUMENTS

| | | | |
|---|---|---|---|
| 1,997,185 | 4/1935 | Sprague et al. | 248/27.3 X |
| 2,892,011 | 6/1959 | Glueckstein | 248/27.3 X |
| 3,146,010 | 8/1964 | Dellith | 292/212 |
| 3,197,247 | 7/1965 | Russell | 70/449 X |
| 3,343,386 | 9/1967 | Hall | 70/370 X |
| 3,503,233 | 3/1970 | Russell et al. | 70/451 X |
| 4,220,808 | 9/1980 | Fujita | 248/27.3 X |
| 4,227,594 | 10/1980 | Kluger | 248/27.3 X |

FOREIGN PATENT DOCUMENTS

| | | | |
|---|---|---|---|
| 553995 | 3/1958 | Canada | 248/27.3 |
| 780237 | 7/1957 | United Kingdom . | |
| 812200 | 4/1959 | United Kingdom . | |
| 821706 | 10/1959 | United Kingdom . | |
| 961685 | 6/1964 | United Kingdom . | |
| 974657 | 11/1964 | United Kingdom . | |
| 998164 | 7/1965 | United Kingdom . | |
| 1036103 | 7/1966 | United Kingdom . | |
| 2109853 | 6/1983 | United Kingdom . | |

*Primary Examiner*—Robert L. Wolfe

*Attorney, Agent, or Firm*—Christie, Parker & Hale

[57] ABSTRACT

A cylinder lock is mounted in an aperture in a panel by means of a retaining ring which has resilient teeth to grip a part of the lock housing which protrudes from the panel. A further ring defining a non-circular aperture is provided in the opening of the panel to co-operate with flats on the lock housing and prevent rotation of the housing in the panel. The lock comprises a main body portion and a hollow spigot projecting from the main body portion and a key receiving member disposed in the spigot wherein the spigot defines an opening at an open end of the spigot remote from the main body portion. The key receiving member defines a key slot which is adjacent the open end of the spigot. The main body portion overlaps a marginal portion of the panel adjacent the panel opening defined thereby and the spigot extends through the aperture from the main body portion and projects from the panel at a second side thereof.

3 Claims, 2 Drawing Figures

MOUNTING A DEVICE ON A MEMBER

BACKGROUND OF THE INVENTION

1. Field of the Invention

This invention relates to the mounting, in apertures in members, of locks, latches, and other devices having housings which are required to be fixed with respect to the members and operating elements which are required to move relative to the housings, in each case the housing being disposed at least partly at one side of the member and the operating element being accessible from the opposite side of the member.

2. Prior Art

In G.B. No. 961,685, there is disclosed a switch comprising a housing which is mounted in an opening in a panel and a push-button mounted in the housing and accessible at a front of the panel. A first part of the housing overlaps the front of the panel and a further part of the housing protrudes through the opening in the panel and carries a retaining ring which grips the housing, overlaps the rear face of the panel and prevents the housing being withdrawn from the opening in the panel. There are formed in the panel at the boundary of the opening recesses which receive complementary projections on the housing of the switch. These projections restrain rotation of the housing relative to the panel.

Retaining rings similar to that disclosed in G.B. No. 961,685 are disclosed in G.B. No. 821,706, G.B. No. 780,237, G.B. No. 974,657, G.B. No. 812,200, G.B. No. 1,036,103 and G.B. No. 2,109,853A. The devices disclosed in these prior publications do not prevent rotation of the member on which they are mounted, relative to a panel through which the member extends.

SUMMARY OF THE INVENTION

According to one aspect of the invention, there is provided an assembly comprising a panel defining an opening, a boundary element which defines a non-circular aperture coinciding with a part of said opening, a retaining element and a device which includes a hollow housing and an operating element mounted in and movable relative to the housing, wherein the boundary element and the panel are in mutually gripping relation adjacent to the opening to restrain rotation of the boundary element about the center of the opening relative to the panel, the housing includes a main portion which lies at a first side of the panel and a hollow spigot which extends through said aperture from the main portion, the spigot has a non-circular profile which complements the shape of the aperture to prevent rotation of the housing relative to the boundary element about the center of the aperture, the spigot has an open end at a second side of the panel, the operating element is at least partly within the spigot and is accessible from the second side of the panel and wherein the retaining element lies at the second side of the panel, overlaps the boundary element and is in gripping relation with the spigot to retain the spigot in the aperture.

The opening defined by the panel may be circular and may be formed by a rotary cutting tool, which may be hand-operated.

According to a further aspect of the invention, there is provided an assembly comprising a panel defining a non-circular aperture, a retaining element and a device which includes a hollow housing and an operating element mounted in and movable relative to the housing, wherein said aperture has a boundary including two curved portions lying on a common curve and two rectilinear portions, each of which is a chord of the common curve, wherein the housing includes a main portion which lies at a first side of the panel and a hollow spigot which extends through said aperture from the main portion, the spigot has a non-circular profile which complements the shape of the aperture to prevent rotation of the housing relative to the panel about the center of the aperture, the spigot has an open end at a second side of the panel, the operating element is at least partly within the spigot and is accessible from the second side of the panel and wherein the retaining element lies at the second side of the panel, overlaps the panel and is in gripping relation with the spigot to retain the spigot in the aperture.

There can be used in an assembly according to the second aspect of the invention a retaining element and device which are identical with those used in an assembly according to the first aspect of the invention.

The panel of an assembly according to the second aspect of the invention may include a boundary element and a carrier for the boundary element, the carrier having a thickness exceeding the thickness of the boundary element and the carrier having a boundary surface which defines an opening, the boundary surface facing towards the center of the opening, and the boundary element being in mutual gripping engagement with the carrier at the boundary surface.

The rectilinear portions of the boundary of the aperture preferably have respective different lengths. The complementary profile of the spigot then prevents assembly of the housing with the panel in all but one orientation relative to the panel.

DESCRIPTION OF THE PREFERRED EMBODIMENTS

Figure 1:
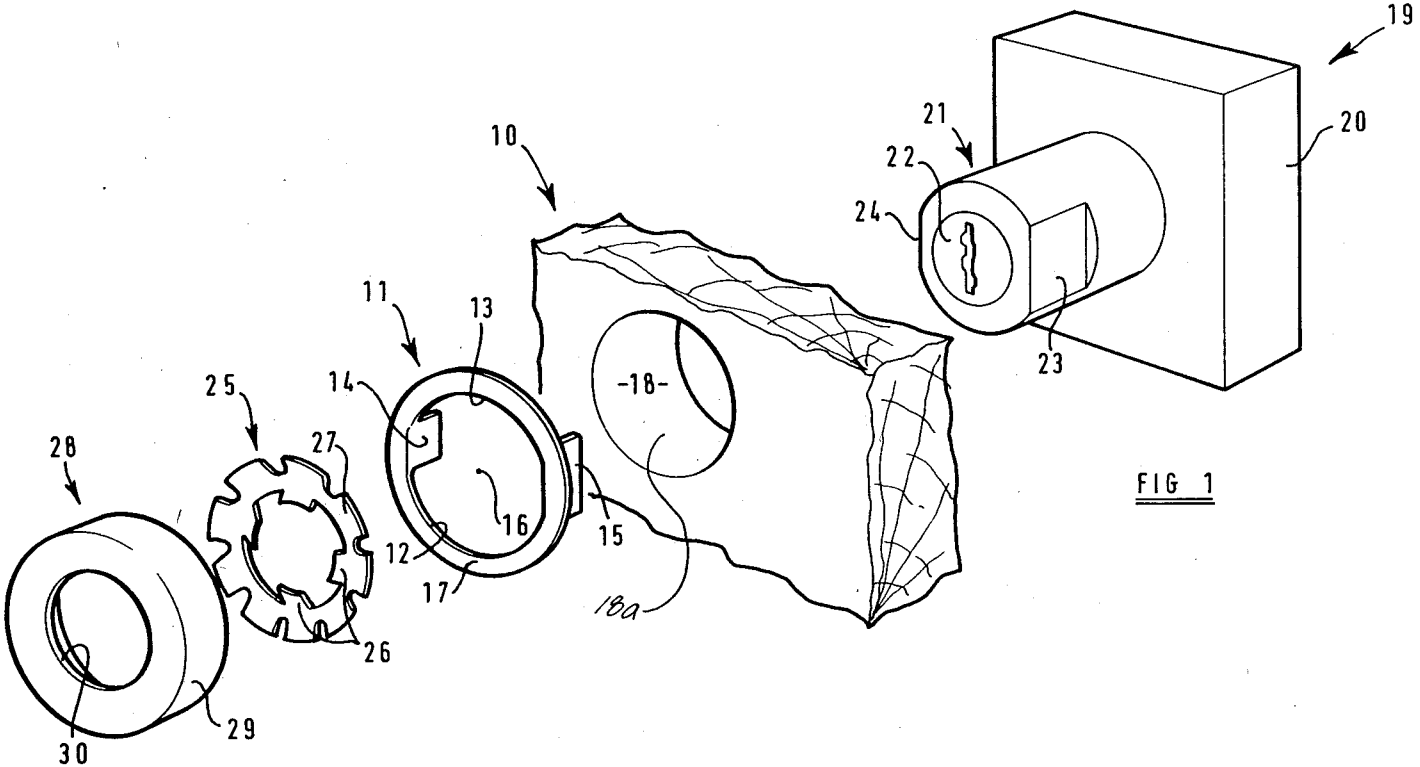
FIG. 1 shows diagrammatically parts of an assembly separated from one another.

The assembly illustrated in FIG. 1 comprises a member defining an aperture which has a non-circular boundary. The member comprises two parts, a relatively thick panel or planar carrier 10 and a relatively thin boundary element 11 of generally annular form, which defines the non-circular aperture. In one form of the invention, the carrier and the boundary element combine as a composite panel. The carrier may have a thickness greater than that of the boundary element. Opposite parts 12 and 13 of the boundary are arcs of a circle, having a common center of curvature 16 and the same radius. Further parts of the boundary are defined by flat lugs 14 and 15, these further parts of the boundary being rectilinear and perpendicular to a diameter drawn through the center of curvature 16. Each of the lugs 14 and 15 presents in a direction away from the center of curvature 16 a flat face which is spaced from that center of curvature by the radius of the boundary parts 12 and 13. The spacing between the center of curvature and each of the lugs is less than the radius of the boundary parts 12 and 13 by an amount equal to the thickness of the sheet metal of which the boundary element 11 is formed.

The circumferential extent of the lug 14 is less than that of the lug 15. No part of the lug 14 lies significantly further from the center of curvature 16 than do the boundary parts 12 and 13. Opposite lateral marginal portions of the longer lug 15 lie substantially further from the center 16 than do the boundary parts 12 and 13. The boundary element is preferably formed as a pressing from sheet metal and includes a ring which is integral with the lugs 14 and 15, connects these lugs together and defines the circular boundary parts 12 and 13. The lugs project from the same side of the ring for a distance which is preferably somewhat greater in the case of the lug 15, than in the case of the lug 14.

The panel 10 is typically a door or drawer front formed of timber or of timber-based sheet material. Alternatively, the panel 10 may be a wall of a piece of furniture. The thickness of the panel 10 is typically within the range 12 mm to 36 mm and is many times the thickness of the sheet metal of which the boundary element 11 is formed.

There is formed in the panel 10 a cylindrical hole 18 having a boundary surface 18*a* and a radius equal to the radius of curvature of the boundary parts 12 and 13. The boundary element 11 is assembled with the panel by inserting the smaller lug 14 into the hole and then forcing the larger lug 15 into the panel. The lateral marginal portions of the lug bite into the material of the panel adjacent to the hole 18 so that rotation of the boundary element 11 relative to the panel 10 about the center 16 is prevented.

The assembly further comprises a device 19 which is mounted in the aperture defined by the panel 10 and boundary element 11. The device comprises a main body portion 20 and a hollow spigot 21 which projects from the body. Typically, the device is a lock. The lock may have a mechanism as described in GB 998,164 but differ from the lock described in that Specification, in that the main body portion 20 and the spigot 21 are preferably formed as die castings. Within the spigot 21, there is mounted an operating element in the form of a key-receiving barrel 22 which, when the proper key is present in the barrel, is rotatable relative to the spigot 21 and main body portion 20. The barrel is exposed at the open end of the spigot, although the barrel may be inset somewhat from the end of the spigot. Alternatively, the device 19 may be a latch, an electrical switch or a valve, in each case having within the spigot an operating element which is required to be moved relative to the spigot and which is accessible through an opening at the end of the spigot remote from the main body portion 19. The movement of the operating element relative to the spigot may be longitudinal displacement, rather than or in combination with rotation.

A part of the external surface of the spigot 21 which is adjacent to the main body portion 20 is cylindrical. A free end portion of the spigot has, on its external surface, two flats 23 and 24, which extend to the free end of the spigot. The device 19 is assembled with the panel 10 by inserting the spigot through the hole 18 from the side of the panel remote from the boundary element 11 until the free end portion of the spigot protrudes from the panel 10 and boundary element 11 and the main body portion 20 is in face-to-face engagement with the panel 10. The flats 23 and 24 than lie close to or in contact with the lugs 15 and 14 respectively, so that rotation of the spigot 21 relative to the panel 10 is prevented. The spigot is preferably a sliding fit in the boundary element 11.

The assembly further comprises a retaining element 25 of generally annular form having at its inner periphery teeth 26. The outer periphery of the element 25 may be circular or may be interrupted by notches to form ears 27, as shown in the drawing. The retaining element is dimensioned to enable the teeth 26 to grip the spigot 21 and the retaining element is assembled with the spigot by driving the retaining element along the spigot into engagement with the ring 17 of the boundary element 11. The teeth 26 are inclined at a small angle to the plane of the adjacent face of the ring 17 in a direction away from the main body portion 20 and towards the interior of the spigot. Accordingly, the teeth tend to bite into the external surface of the spigot if there is exerted on the retaining element a force tending to move the retaining element relative to the spigot in a direction away from the main body portion 20. It will be seen that the panel 10 is trapped between the retaining element 25 and the main body portion 20 and that movement of the spigot 21 in either direction through the hole 18 is prevented. Furthermore, it will be noted that the effectiveness of the retaining element 25 in preventing movement of the spigot through the hole 18 is not dependent on the panel 10 having a predetermined thickness. The thickness of the panel may vary within a limited range. If an assembly having a thicker panel is required, a longer spigot may be provided on the device 19.

The assembly further comprises a cap 28 having an approximately cylindrical side wall 29 and an end wall 30 defining an opening through which the operating element 21 is accessible. The side wall 29 is driven over the retaining element 25. The retaining element is shaped to space the ears 27 somewhat from the boundary element 11 and the side wall 29 is swaged radially inwardly towards the spigot 21 in the space between the ears 27 and the boundary element 11 so that the cap is firmly held on the retaining element. The end wall 30 covers an end face of the spigot 21.

In the assembly illustrated in FIG. 2, certain parts correspond to parts already described with reference to FIG. 1. Such corresponding parts are identified in FIG. 2 by like reference numerals with the prefix 1 and the preceding description is deemed to apply, except for the differences hereinafter mentioned.

Figure 2:
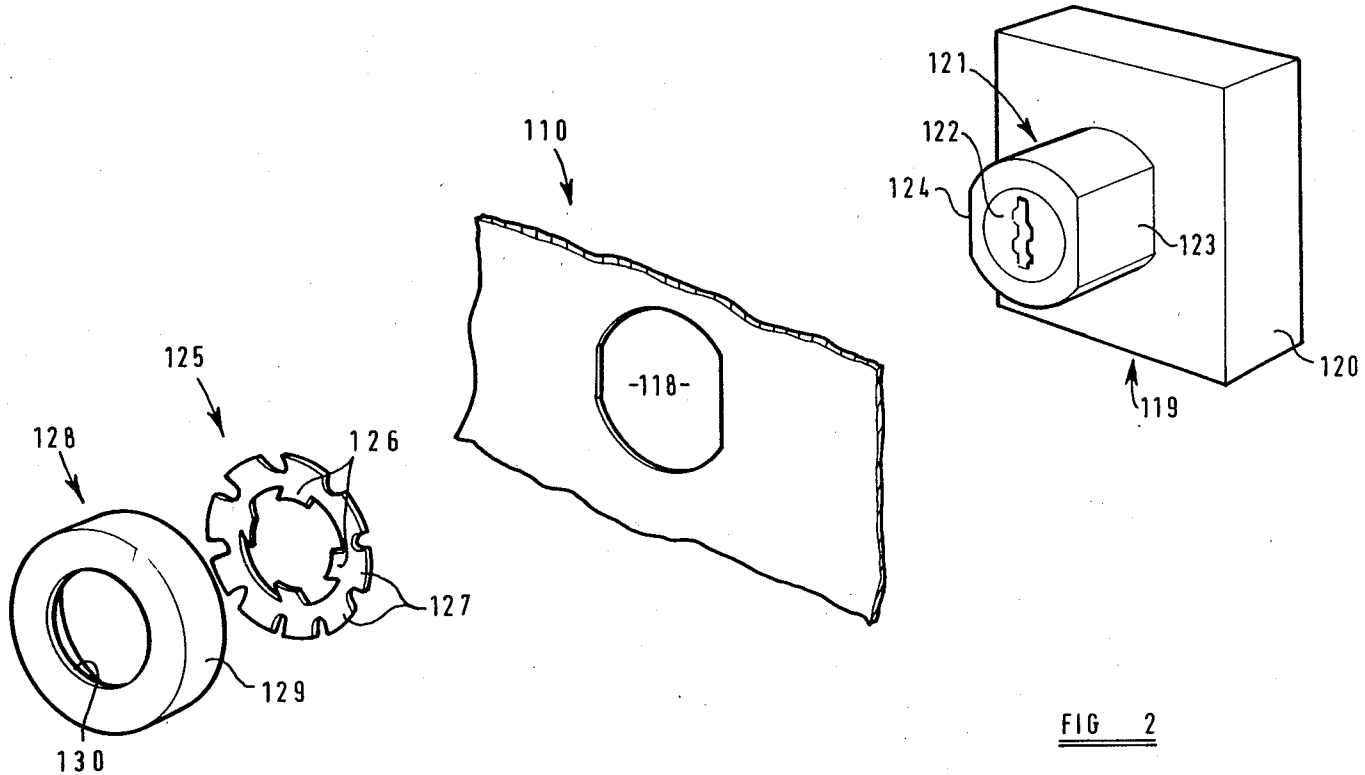
FIG. 2 shows, on a smaller scale, a similar representation of an alternative assembly.

The panel 110 shown in FIG. 2 is relatively thin and is formed of sheet metal. The hole 118 is non-circular and has rectilinear portions with which flats 123 and 124 on the spigot 121 engage. These flats extend along the entire length of the spigot, which is shorter than the spigot 21. The assembly of FIG. 2 does not include an element corresponding to the boundary element 11 of the assembly of FIG. 1. In other respects, the assembly of FIG. 2 is the same as that of FIG. 1. The hole 118 is conveniently formed in the panel 110 by a pressing operation.

In the assemblies of FIGS. 1 and 2, the lock or other device is firmly restrained against displacement relative to the panel in which it is mounted and against rotation relative to the panel in the aperture of the panel. Furthermore, the retaining element which holds the device in the aperture of the panel is inaccessible. It will be noted that there are no screws or other threaded fasteners which could be undone to release the device from the panel.

The lock described in GB No. 998,164 is normally mounted on sheet metal panels by riveting. The mounting of the device of FIG. 2 on the panel 110 is less permanent than is reveting. By means of a special tool, the device can be removed from the panel without causing significant damage to the panel. This tool has a pair of blade-like jaws which are forced between the cap 128 and the panel 110 at diametrically opposite positions. The cap and then the retaining element 125 are forced away from the panel 110 until the retaining element is pulled completely off the spigot 121. Thus, if the device 119 is unsatisfactory in any way, it can be removed from the panel and replaced. During removal of the cap and retaining element from the spigot, the retaining element suffers deformation which may be resilient deformation or permanent deformation. The cap is permanently deformed. Furthermore, some material may be removed from the surface of the spigot. However, the spigot is not normally damaged to such a degree that the device 119 is rendered useless by removal of the retaining element. The retaining element also may be capable of being re-used, although normally a fresh retaining element and fresh cap would be applied.

It will be noted that the assembly of FIG. 2 can incorporate panels 110 of different thicknesses with identical devices 119 and without there arising any looseness in the assembly.

I claim:

1. An assembly comprising a panel defining a panel opening having a center, a boundary element which defines a non-circular aperture having a center and coinciding with a part of said opening, an annular retaining element and a lock comprising a main body portion and a hollow spigot projecting from the main body portion and a key-receiving member disposed in the spigot wherein the spigot defines an opening at an open end of the spigot remote from the main body portion, the key-receiving member defines a key-slot which is adjacent the open end of the spigot, the boundary element and the panel are in mutually gripping relation adjacent the panel opening to restrain rotation of the boundary element about the center of the panel opening relative to the panel, the main body portion lies at a first side of the panel, the main body portion overlaps a marginal portion of the panel adjacent the panel opening defined thereby, the spigot extends through said aperture from the main portion and projects from the panel at a second side thereof, the spigot has a non-circular profile which complements the shape of the aperture to restrain rotation of the lock relative to the boundary element about the center of the aperture, the open end of the spigot and the key-slot lie at the second side of the panel and wherein the retaining element lies at the second side of the panel, overlaps and engages the boundary element and is in gripping relation with the spigot to retain the spigot in the aperture.

2. An assembly comprising a panel defining a non-circular aperture, a retaining element and a lock comprising a main body portion, a hollow spigot projecting from the main body portion and a key-receiving member disposed in the spigot wherein said aperture has a boundary including two curved portions lying on a common curve and two rectilinear portions, each of which is a chord of the common curve, wherein the main body portion lies at a first side of the panel and the spigot extends through said aperture from the main body portion, the spigot has a non-circular profile which complements the shape of the aperture to restrain rotation of the lock relative to the panel about a center of the aperture, the spigot defines an open end at a second side of the panel, the key-receiving member defines a key-slot which is adjacent the open-end of the spigot and lies at the second side of the panel, the main body portion overlaps the panel and wherein the retaining element lies at the second side of the panel, overlaps the panel and is in gripping relation with the spigot to retain the spigot in the aperture.

3. An assembly according to claim 2 wherein the panel includes a boundary element and a carrier for the boundary element, the carrier has a thickness exceeding the thickness of the boundary element, the carrier has a boundary surface defining the aperture having a center, the boundary surface faces towards the center of the aperture and the boundary element is in mutual engagement with the carrier of the boundary surface.

* * * * *